US006920859B2

(12) United States Patent
Oh

(10) Patent No.: US 6,920,859 B2
(45) Date of Patent: Jul. 26, 2005

(54) CYLINDER LINER

(75) Inventor: Min-Kyu Oh, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/749,212

(22) Filed: Dec. 30, 2003

(65) Prior Publication Data

US 2005/0005891 A1 Jan. 13, 2005

(30) Foreign Application Priority Data

Jul. 10, 2003 (KR) ..... 10-2003-0046685

(51) Int. Cl.[7] ..... F02F 1/00
(52) U.S. Cl. ..... 123/193.2
(58) Field of Search ..... 123/193.2; 29/888.061

(56) References Cited

U.S. PATENT DOCUMENTS 3,165,983 A * 1/1965 Thomas ..... 92/169.1
4,221,196 A * 9/1980 Castarede ..... 123/41.84
5,291,862 A * 3/1994 Katoh et al. ..... 123/193.2
5,749,331 A * 5/1998 Pettersson et al. ..... 123/193.2
6,123,052 A * 9/2000 Jahn ..... 123/41.79
6,298,818 B1 * 10/2001 Koyama et al. ..... 123/193.2

FOREIGN PATENT DOCUMENTS

JP 8 290255 11/1996

* cited by examiner

*Primary Examiner*—Marguerite McMahon
(74) *Attorney, Agent, or Firm*—Morgan, Lewis & Bockius LLP

(57) ABSTRACT

A cylinder liner that can be accurately positioned and can securely maintain a stable state relative to a base metal of a cylinder block to thereby minimize deformation of the cylinder bore, limit abrasion of a piston and a piston ring, reduce consumption of oil and to effectively prevent damage to an engine.

3 Claims, 2 Drawing Sheets

CYLINDER LINER

CROSS-REFERENCE TO RELATED APPLICATIONS

This application claims priority of Korean Application No. 10-2003-0046685, filed on Jul. 10, 2003.

FIELD OF THE INVENTION

The present invention relates to a structure of a cylinder liner in an engine, and more particularly, to a technique with regard to an external surface structure of a cylinder liner for manufacturing an aluminum cylinder block by inserting a cylinder liner and casting same at high pressure.

BACKGROUND OF THE INVENTION

A cylinder liner of an engine serves to guide the movement of the piston ring, and contains therein a quantity of oil to restrict excessive abrasion of the piston and the piston ring, thereby reducing consumption of oil and preventing damage of the engine in the long run.

In a cylinder block manufacturing method where a cylinder liner is directly welded to a base material during casting of a cylinder block, it should be apparent that the cylinder liner and the base material must be securely adhered therebetween. This is because deformation of an inner bore at the cylinder liner caused by residual stress generated in the course of casting the cylinder block should be minimized even under high temperature operating conditions during operation of an engine, and the function of the cylinder liner thus described should be properly carried out.

SUMMARY OF THE INVENTION

Embodiments of the present invention provide a cylinder liner wherein the cylinder liner and cylinder block are tightly secured to a base metal to restrict deformation of a cylinder bore and abrasion of a piston and a piston ring and to reduce consumption of oil, thereby effectively preventing damage of an engine in the long run.

In accordance with a preferred embodiment of the present invention, a cylinder liner includes an exterior surface comprising a plurality of liner lugs. Each liner lug radially protrudes from the external surface of the cylinder liner and has a narrow section like a bottleneck.

BRIEF DESCRIPTION OF THE DRAWINGS

For fuller understanding of the nature and objects of the present invention, reference should be made to the following detailed description taken in conjunction with the accompanying drawings in which.

DETAILED DESCRIPTION OF THE PREFERRED EMBODIMENT

The preferred embodiment of the present invention will be described in detail with reference with the accompanying drawings.

Figure 1:
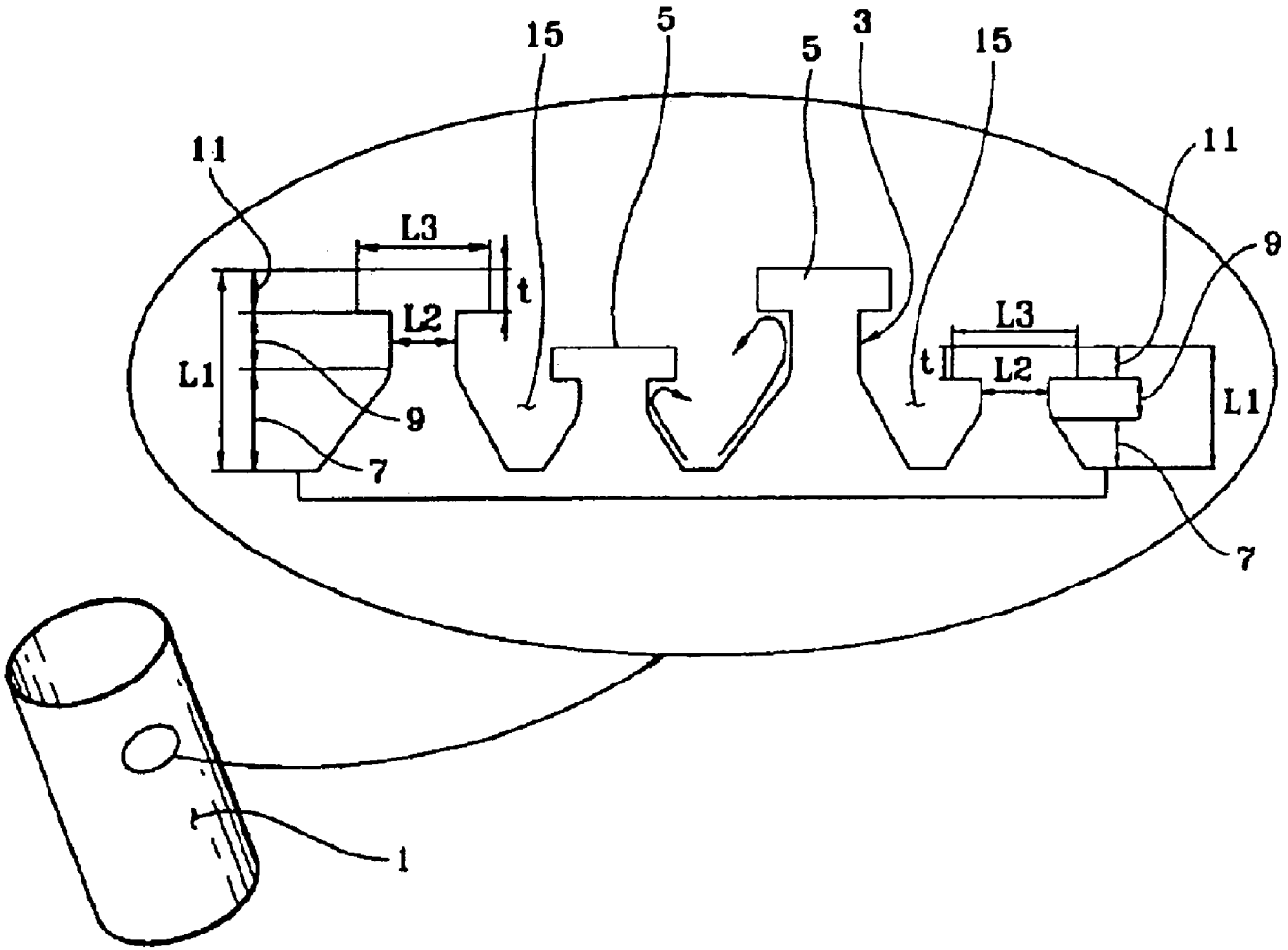
FIG. 1 is a schematic drawing illustrating a cylinder liner according to an embodiment of the present invention.

As illustrated in FIG. 1, a cylinder liner 1 includes an external surface having a plurality of liner lugs 5 radially protruding therefrom. Each liner lug 5 includes a narrowed section 3 formed like a bottleneck. In a preferred embodiment of the present invention, the liner lug 5 is further disposed with a first lug part 7 protruding from an external surface of the cylinder liner 1 and having a tapering-off section, a second lug part 9 extended from the first lug part 7 and having the narrow section 3 and a third lug part 11 having a square section bulging out from the second lug part 9.

The second lug part 9 is formed with an approximately constant cross-section along the protruding direction of the liner lug 5. It is preferred that the protruding height (L1) of the liner lug 5 is about 0.7 mm–1.0 mm, width (L2) of the second lug part 9 perpendicular to the protruding direction of the liner lug 5 is about 0.3 mm–0.35 mm, width (L3) of the third lug part 11 perpendicular to the protruding direction of the liner lug 5 is about 0.4 mm–0.5 mm, and protruding height (t) of the third lug part 11 is about 0.1 mm–0.2 mm.

Figure 2:
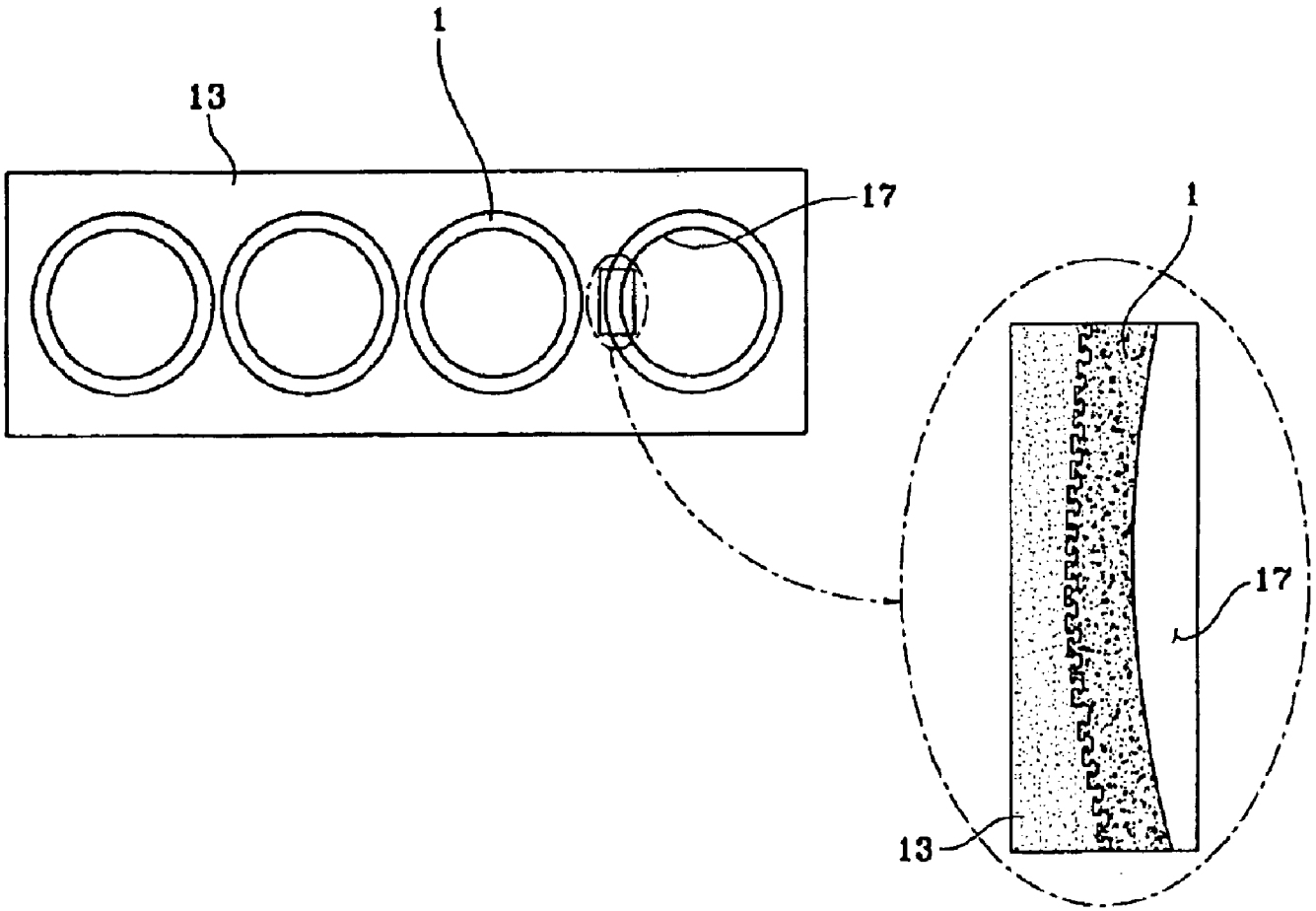
FIG. 2 is a schematic drawing illustrating a state where the cylinder liner of FIG. 1 is integrally combined with a cylinder block.

When melted aluminum base metal is poured into a mold for manufacturing a cylinder blocks 13 while the cylinder liner 1 is securely fixed to the mold, lug grooves 15 formed among the liner lugs 5 are filled with the aluminum base metal. As shown in FIG. 2, when the aluminum base metal is cooled to complete the cylinder blocks 13, the cylinder liner 1 is integrally and tightly combined with the base metal comprising the cylinder blocks by the coupling between the aluminum filled in the lug grooves 15 and the liner lugs 5.

When the cylinder liner 1 is inserted and cast to manufacture the cylinder blocks 13, a residual stress is generated between the cylinder liner 1 and the base metal by the cooling of the aluminum base metal as in the prior art. Even if the residual stress acts on while an engine is running, a strong coupling structure between the lug grooves 15 and the liner lugs 5 overcomes the residual stress thus described, thereby enabling to tightly support the cylinder liner 1 relative to the cylinder blocks 13.

In other words, when the aluminum base metal filled in the lug grooves 15 tries to detach from the lug grooves 15 under residual stress of the cylinder blocks 13, the third lug part 11 at the liner lug 5 acts as a hitching jaw, whereby the aluminum base metal trying to get detached from the lug grooves 15 is pulled into the inner side of the lug grooves 15 again as shown in arrow direction of FIG. 1, thereby preventing the aluminum base metal from being detached from the lug grooves 15.

Even if the residual stress of the cylinder blocks 13 acts on the coupling area between the liner lug 5 and the aluminum base metal, the cylinder liner 1 can maintain an accurate position and a stable state relative to the cylinder blocks 13 when the aluminum base metal filled in the lug grooves 15 is prevented from being detached, thereby minimizing deformation of a bore 17.

When the bore 17 is minimized in deformation thereof, abrasion of a piston and a piston ring is limited to reduce the consumption of oil, effectively avoiding damage of an engine in the long run.

As apparent from the foregoing, there is an advantage in the cylinder liner thus described according to the present invention in that a cylinder liner can be positioned at an accurate place and can securely maintain a stable state to minimize the deformation of a bore, limit the abrasion of a piston and a piston ring, reduce consumption of oil and effectively prevent the damage of an engine in the end.

What is claimed is:

1. A cylinder liner comprising a plurality of liner lugs, each liner lug radially protruding from an external surface of the cylinder liner, and each liner lug being formed with a narrowed section, wherein said liner lug comprises: a first lug part protruding from an external surface of said cylinder liner and having a tapering-off section; a second lug part extended from said first lug part and having a narrow section; and a third lug part having a square section bulging out from said second lug part.

2. The cylinder liner as defined in claim 1, wherein said second lug part is so formed as to have the same size of cross-section along the protruding direction of said liner lug.

3. The cylinder liner as defined in claim 2, wherein a protruding height of said liner lug is about 0.7 mm–1.0 mm, a width of said second lug part perpendicular to the protruding direction of said liner lug is about 0.3 mm–0.35 mm, a width of said third lug part perpendicular to the protruding direction of said liner lug is about 0.4 mm–0.5 mm, and a protruding height of said third lug part is about 0.1 mm–0.2 mm.

* * * * *